US007946269B2

(12) United States Patent
Gerum et al.

(10) Patent No.: US 7,946,269 B2
(45) Date of Patent: May 24, 2011

(54) METHOD AND DEVICE FOR INCREASING THE ENGINE BRAKE POWER OF A RECIPROCATING PISTON INTERNAL COMBUSTION ENGINE OF A VEHICLE, PARTICULARLY OF A DIESEL ENGINE

(75) Inventors: Eduard Gerum, Rosenheim (DE); Hubert Hitziger, Worms (DE)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 0 days.

(21) Appl. No.: 12/639,400

(22) Filed: Dec. 16, 2009

(65) Prior Publication Data

US 2010/0122687 A1 May 20, 2010

Related U.S. Application Data

(63) Continuation of application No. PCT/EP2008/004907, filed on Jun. 18, 2008.

(30) Foreign Application Priority Data

Jun. 19, 2007 (DE) ..... 10 2007 027 968

(51) Int. Cl.
*F02D 13/04* (2006.01)
*F01L 13/06* (2006.01)

(52) U.S. Cl. ..... 123/321; 123/327

(58) Field of Classification Search ..... 123/320, 123/321, 327

See application file for complete search history.

(56) References Cited

U.S. PATENT DOCUMENTS

| | | | | |
|---|---|---|---|---|
| 2003/0178002 | A1 * | 9/2003 | Israel et al. | 123/321 |
| 2006/0260567 | A1 * | 11/2006 | Roithinger | 123/41.31 |
| 2007/0113803 | A1 * | 5/2007 | Froloff et al. | 123/90.11 |
| 2007/0137200 | A1 * | 6/2007 | Rammer et al. | 60/602 |
| 2007/0245982 | A1 * | 10/2007 | Sturman | 123/26 |
| 2007/0246008 | A1 | 10/2007 | Gerum | |
| 2007/0277793 | A1 * | 12/2007 | Warren | 123/563 |
| 2008/0072595 | A1 | 3/2008 | Nemeth et al. | |

FOREIGN PATENT DOCUMENTS

| | | | |
|---|---|---|---|
| DE | 102 24 719 | A1 | 12/2003 |
| DE | 10 2004 047 975 | A1 | 4/2006 |
| WO | WO 2005/079418 | A2 | 9/2005 |
| WO | WO 2006/074497 | A2 | 7/2006 |
| WO | WO 2006/089779 | A1 | 8/2006 |
| WO | WO 2007/058524 | A1 | 5/2007 |

OTHER PUBLICATIONS

International Search Report dated Oct. 16, 2008 with English translation (six (6) pages).

* cited by examiner

*Primary Examiner* — Erick Solis
(74) *Attorney, Agent, or Firm* — Crowell & Moring LLP

(57) ABSTRACT

A method for increasing an engine brake power of an internal combustion engine, particularly of a diesel engine, having at least one cylinder with a reciprocating piston, at least one inlet valve and one outlet valve, and a turbocharger, in which air is compressed by an air compressor and stored in the at least one storage device, and air is injected in a clocked manner into the at least one cylinder in order to increase the compression work performed by the piston and thereby enhance the engine brake power during an engine braking process.

15 Claims, 1 Drawing Sheet

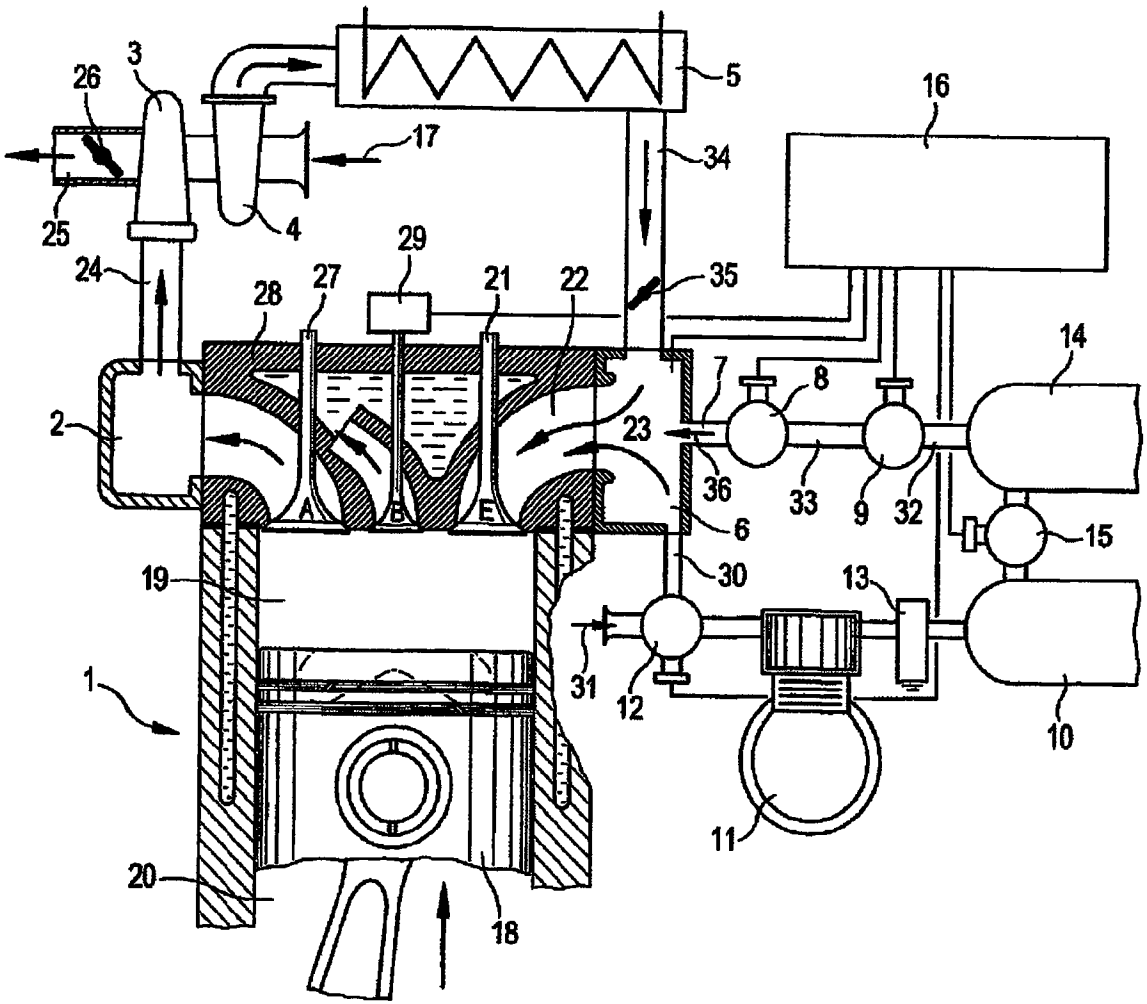
1
2
3
4
5
6
7
8
9
10
11
12
13
14
15
16
17
18
19
20
21
22
23
24
25
26
27
28
29
30
31
32
33
34
35
36
A
B
E

METHOD AND DEVICE FOR INCREASING THE ENGINE BRAKE POWER OF A RECIPROCATING PISTON INTERNAL COMBUSTION ENGINE OF A VEHICLE, PARTICULARLY OF A DIESEL ENGINE

CROSS-REFERENCE TO RELATED APPLICATIONS

This application is a continuation of PCT International Application No. PCT/EP2008/004907, filed Jun. 18, 2008, which claims priority under 35 U.S.C. §119 to German Patent Application No. DE 10 2007 027 968.1, filed Jun. 19, 2007, the entire disclosures of which are herein expressly incorporated by reference.

BACKGROUND AND SUMMARY OF THE INVENTION

The invention relates to a method and a device for increasing the engine brake power of a reciprocating piston internal combustion engine of a vehicle, particularly of a diesel engine, comprising at least one cylinder with at least one inlet valve and one exhaust valve in each case, a turbine, a compressor, an air compressor, at least one storage device, a charge air line and a control device.

With the increasing degree of boosting of diesel engines boosted by turbocharger devices having a turbine and a compressor, the reduction in engine capacity and size are made. Engine brake power, referred to hereinafter as "brake power," is also being reduced. However, in the case of boosted diesel engines, a brake power which increases adequately with engine power must in all cases be available. A lack of adequate brake power arises in particular, therefore, with the current "downsizing" of engines in which large-capacity, heavy engines are being replaced by small-capacity, lighter engines with significantly increased specific power output.

For this reason the central problem which must be solved when "downsizing" is, above all, that of generating high brake power, which should correspond to that of the larger engine, in order not to overload the conventional brake system while traveling downhill, for example, or impair the usual driving comfort.

At the same time, however, decreases of brake power in normal driving which occur with frequent reductions of engine load and speed, which large engines can partly bridge with their flywheel effect, must be compensated in the case of smaller engines with rapidly available brake forces generated in the cylinder.

So-called exhaust throttle valves, which make possible increased exhaust backpressure and therefore improved engine brake power at high engine speeds by more or less completely closing the exhaust gas line in order to achieve high engine braking moments, are known in the prior art. A disadvantage of this simple technology is that the brake power is achieved predominantly only by the throttling losses of the exhaust gases pushed back and forth in the more or less sealed chamber between piston head and exhaust valve, which process, apart from modest efficiency gains—the maximum achievable brake power equals approximately 50% of engine power—also leads, above all, to undesired heating of the exhaust and injection valves, which are highly stressed thermally in any case. For this reason a substantially improved brake power of up to more than 100% of engine power is achieved by systems which exploit the compression work of the engine by venting the compressed combustion air at the end of the compression stroke by briefly opening the gas exchange valves or by a separate, controlled "brake valve" in the cylinder head, which combustion air can therefore no longer act as a work accumulator which re-exerts on the descending piston (that is, during the working stroke of the ignited engine) the compression work stored in the aspirated combustion air.

It is already clear from the above that the quantity of air introduced into the cylinder during braking operation is a measure for the compression work and therefore also for engine brake power, in these effective engine brake systems.

This effect is reinforced by the fact that during braking operation, also called overrun operation—especially in the case of boosted engines in which no charge pressure is present in this operating state—engines work with relatively poor degrees of cylinder filling, which result from the flow resistances in the intake system and are progressively increased by the elevated engine speeds during braking operation. Moreover, precisely in the case of boosted engines the compression ratio must be significantly lowered as compared to naturally aspirated engines (e=21 to e=16) in order to limit ignition pressures, which also leads to a significant reduction in compression work and therefore in brake power.

It is also known, in vehicles with diesel engines with a compressed air brake system, to draw compressed air from a compressed air storage device which is separated from the brake system proper for safety reasons, the supply of this additional quantity of injection air being generated by an enlarged air compressor, as compared to the standard compressed air brake system, or by boosting with surplus boost air from the engine. This "additional air" is supplied to the engine in the intake system, that is, before or after the turbocharger, to improve acceleration. It is also known that an increase in torque in the low-load range can be achieved by this method. A disadvantage, however, is the high consumption of air which results from the fact that the additional air is not supplied to the individual cylinders in a specified and timed manner. This disadvantage is avoided by the most recent air injection systems known to the applicant, which inject the required quantity of additional air in a timed manner with electronically controlled and regulated pneumatic components, which may be integrated in the engine electronics, for example in the electronically controlled fuel injection system.

It is therefore the object of the invention to improve the engine brake power of a reciprocating piston internal combustion engine of such a vehicle.

The invention provides a method by which additional air is supplied in a timed manner in the braking phase to each cylinder of the engine individually or to the intake tract as a whole.

The systems already developed for increasing engine power and torque are extended to the effect that, in combination with the same or similar mechanical, pneumatic and electronic components for increasing torque, cylinder filling together with engine brake power is increased in a simple manner by means of timed air injection during braking operation, so that the compression work and also, in combination with the known venting devices, the brake power is increased significantly above the state of the art, and the aforementioned disadvantages with boosted and therefore smaller-capacity engines are thus eliminated or at least considerably reduced.

A method according to the invention for increasing the engine brake power of a reciprocating piston internal combustion engine of a vehicle, in particular of a diesel engine, comprising at least one cylinder with at least one inlet valve and one exhaust valve in each case, a turbine, a compressor, an air compressor, at least one storage device, a charge air line and a control device, is characterized by the following procedural steps:

compressing of air from a charge air line or from a second air inlet by the air compressor;

storing of the air compressed by the air compressor in at least one storage device; and timed injection of injection air, which is stored as compressed air in the at least one storage device and/or is delivered from the air compressor, into the cylinder in order to increase the compression work so as to enhance the engine brake power during a braking process.

It is thereby advantageously achieved that the quantity of additional injection air is consumed only in an order of magnitude which corresponds to the brake power of the engine at the time. A saving in storage space for this injection air and in the associated compressor output is also achieved thereby. This method is suited to vehicles with and without a compressed air brake system.

In the case of vehicles with a compressed air brake system it is especially advantageous that, during the procedural step of storing, the compressed air is first fed to a first storage device and stored therein, and that the air stored in the first storage device is transferred to a second storage device via a feed valve for storage in the second storage device when a given quantity of air at a given pressure is present in the first storage device.

In an embodiment of the present invention the feed valve is controlled by the control device, whereby it is advantageously ensured that the compressed air brake system does not suffer a compressed air loss. At the same time, monitoring of the pressure is possible.

In a preferred embodiment according to the invention, the procedural step of the timed injection comprises the following partial steps:

determining by the control device of an operating state of the engine and the vehicle with reference to data of an engine control computer and/or to suitable sensors;

sensing of a pressure in the at least one storage device by a sensor and/or via a pressure regulator, of a charge pressure in the charge air line and of an engine speed, which correspond to a braking operation, and transmission of this information to the control device;

injecting of injection air by opening a control valve to the inlet valve of the cylinder by the control device for injecting injection air into the cylinder when the inlet valve is opened and an operating state of the engine is present during a braking process;

ending the injection of injection air into the cylinder when the braking process is ended.

In this configuration the particular advantage lies in the timed injection of the additional injection air as a function of brake power actually required. An injection of additional air advantageously takes place only when it is needed. A large saving is thereby achieved.

In a further embodiment a time segment for opening the control valve by the control device is determined, in the partial step of injecting, by a predefinable or stored data value. It is thereby achieved that the injection air is superimposed on the flow of charge air present in the inlet duct and a temperature exchange can therefore take place between these gases, which therefore also advantageously counteracts overheating of the parts close to the combustion chamber. Furthermore, it is advantageously achieved through this predefinable time segment that, for a given duration of injection, the latter is ended early enough, so that no backflow of injection air from the cylinder into the intake system or the charge air line takes place and causes disturbances therein.

In an especially preferred configuration the control device adjusts the quantity of injection air by the pressure regulator as a function of the operating state of the engine and the vehicle at the time. An especially effective increase in engine brake power is thereby achieved, since the injection quantity is dependent on a plurality of operating parameters. To this end it is also a major additional advantage that the quantity of air injected into the engine is adjusted by the control device as a function of the required engine brake power with reference to predefinable stored table values in a mutually coordinated manner.

In a preferred configuration an inlet of the air compressor is connected via a change-over valve to a second air inlet or to the charge air line as a function of a pressure prevailing in the charge air line at the time. The capacity of the air compressor is thereby advantageously increased and use of a larger and more expensive air compressor avoided.

A device for increasing the engine brake power of a reciprocating piston internal combustion engine of a vehicle, in particular of a diesel engine, comprising at least one cylinder with at least one inlet valve and a brake valve in each case, a turbine, a compressor, an air compressor, a storage device, a charge air line and a control device, is characterized in that an outlet of the storage device is connected via a control valve to an inlet duct or to the intake tract of the engine. By means of the control valve it is possible to control the injection air in an advantageously simple manner, since this valve is opened by the control device only when injection of injection air is necessary on the basis of operating conditions.

In a vehicle with a compressed air brake system an inlet of a second storage device is connected via a feed valve to a first storage device. The compressed air brake system with its storage device and its compressed air generating capacity is thereby also usable for the compressed air generation of the injection air, the second storage device representing a particular security measure for the compressed air brake system since it forms a separate compressed air circuit for injecting the compressed air stored therein.

In a preferred configuration the control valve and the outlet of the second storage device are connected via a pressure regulator, said pressure regulator making it possible, via adjustment of the pressure of the injection air which flows through it during injection, to adjust the quantity of injection air in a simple manner.

It is advantageous if the air injection line is connected via an injection duct or an injection line to the inlet duct, the injection duct or injection line being formed in the cylinder head of the engine or arranged in the inlet duct, since specified injection, for example independently of the pressure conditions in the charge air duct, is thereby achieved.

In a further embodiment, a heat exchanger is arranged in the connecting line from the outlet of the second storage device to the injection duct or to the injection line. Via this heat exchanger the injection air can advantageously be cooled during braking operation and thereby contribute to reducing the thermal stress on the engine.

The invention is explained with reference to an exemplary embodiment and to the appended drawing. The single FIGURE shows a schematic representation of parts of an engine with associated components, with an exemplary configuration of the device according to the invention for carrying out the method according to the invention.

Other objects, advantages and novel features of the present invention will become apparent from the following detailed description of one or more preferred embodiments when considered in conjunction with the accompanying drawing.

BRIEF DESCRIPTION OF THE DRAWING

The FIGURE shows a schematic representation of parts of an engine of a vehicle with components in accordance with the present invention.

DETAILED DESCRIPTION OF THE DRAWING

Only one cylinder 20 of the engine 1, which may comprise one or more cylinders, is shown in the FIGURE by way of example in its upper region in partial section, with a reciprocating piston 18 arranged displaceably therein. The cylinder 20 is closed at its upper end by a cylinder head 28 which also has one or more inlet valves 21 with one or more inlet ducts 22, and one or more exhaust valves 27 with one or more exhaust ducts and an exhaust gas line 2 connected thereto. The cylinder 20 is shown in cutaway form, above a crankshaft (not shown).

The valves 21 and 27 open according to the working cycle of the engine 1, downwardly in this example, into a combustion chamber 19 arranged between the top of the reciprocating piston 18 and the underside of the cylinder head 28. The so-called compression stroke is shown, in which the inlet valve 21 and the exhaust valve 27 are closed and the reciprocating piston 18 is moving upwardly in the direction of the arrow away from the crankshaft in order to reduce the size of the combustion chamber 19. The operation of such an engine 1, in particular a diesel engine, is known and is not explained further.

Within the course of the exhaust gas line 2, a turbine 3 with a compressor coupled thereto is connected via an exhaust gas line 24 of the turbine 3. An exhaust butterfly valve 26 of a conventional engine brake is installed in an exhaust gas line 25 downstream of the turbine 3. The compressor 4 has a first air inlet 17. In this example, an outlet of the compressor 4 is connected via a charge air cooler 5 through a charge air supply line 34 to the charge air line 6 of the cylinder head 28. The operation of turbine 3, compressor 4 and charge air cooler 17 are known and are not explained further.

Schematically illustrated in the cylinder head 28 is a further, controlled "brake valve" 29 which, upon reaching of top dead center by the piston 18, vents the air compressed in the combustion chamber, preferably into the exhaust gas line 25 downstream of the turbine, so that the compression work generated in the cylinder during the compression phase is abolished.

The charge air line 6, shown here in schematically simplified form, is further connected to a first connection of a change-over valve 12 which is connected by a second connection to a second air inlet 31. A third connection of the change-over valve 12 is in communication with an inlet connection of an air compressor 11, the outlet connection of which is connected via a drier device 13 to a first storage device 14.

The first storage device 10 serves as a compressed air accumulator for a compressed air brake system of the vehicle (not shown) and is charged with compressed air by the air compressor 11. The associated brake system is not illustrated.

The first storage device 10 is further connected via a feed valve 15 to a second storage device 14 which is also used as a compressed air accumulator. Its outlet connection is connected via an air line 32 to an inlet of a pressure regulator 9 which in turn is connected by its outlet via a connecting line 33 to an inlet of the control valve 8. The control valve 8 is in communication by its outlet with an air injection conduit 7.

The control of the valves 8, 12, 15 and of the pressure regulator 9 is carried out by a control device 16, shown as a block in the FIGURE. Said control device 16 is connected to the valves 8, 12, 15 and the pressure regulator 9, for example via electric connecting lines, the valves 8, 9, 12, 15 being in the form of solenoid valves.

Connected to the control device 16 is a respective actuator per cylinder, which actuator is located on the engine 1. In this exemplary embodiment it is an injection device for fuel. Further sensors for temperature, pressure, etc., may also be contained therein. The control device 16 includes a so-called engine control computer, or is connected thereto. From this engine control computer the control device 16 receives necessary information on the operating state of the engine 1 and of the vehicle, such as rotational speed and load of the engine 1, vehicle speed, temperature of engine 1, of intake air, exhaust gas and the like.

In what follows, the operation of the individual components is described in more detail in order to explain the method according to the invention.

The air compressor 11 compresses air which is supplied to its inlet either from a second air inlet 31 or from the charge air line 6 via the change-over valve 12. Upon starting of the engine 1, at low engine speeds or in certain operating states of the engine 1 and/or of the vehicle, the change-over valve 12 connects the air compressor 11 to the second air inlet 31. In normal operating states of the engine 1, in which sufficient charge air is delivered by the compressor 4 of the turbocharger, the change-over valve 12 connects the air compressor 11 to the charge air line 6, so that the capacity of the air compressor 11 is thereby advantageously increased and the installation of a larger and more expensive air compressor 11, together with a change to the brake system, is avoided.

The air compressed by the air compressor 11 is dried by the drier device 13, in a manner known for use of compressed air in a compressed air brake system, and stored in the first storage device 10. A connection (not shown) on the first storage device 10 supplies the compressed air stored therein for use in the compressed air brake system of the vehicle (also not shown).

If the compressed air brake system is supplied sufficiently with compressed air, which situation is communicated by pressure sensors (not shown) to the control device 16, the second storage device 14 is charged with compressed air from the first storage device 10 via the feed valve 15. For the compressed air brake system the feed valve 15 has the function of a safety valve ensuring that compressed air cannot be lost by this route. In this charging process the control device compares the value supplied by the pressure sensor to a predefinable reference value and switches the feed valve 15 on or off accordingly. The feed valve 15 may also be configured autonomously.

The pressure regulator 9 at the outlet of the second storage device 14 opens and closes automatically as a function of the pressure inside the second storage device 14. In this case, too, control may be effected by the control device 16 via a sensor and a pressure regulator in electrical form, as indicated by a connecting line in the FIGURE.

During braking operation of the engine 1 the compressed air is supplied as injection air 36 via the control valve 8 controlled by the control device 16 from the second storage device 14 via the air injection duct 7 to the intake tract of the engine 1 via the inlet valves 21.

The clock timings of the start and end of injection of the additional injection air 36 from the second storage device 14 are selected and predefinable for the control device in such a manner that the injection air 36 is superimposed on the inlet flow 23 present in the inlet duct 22.

The end of injection is defined and predefinable for the control device 16 in such a manner that, upon attainment of a sufficient peak braking power, the timed quantity of injected air is reduced and, as soon as the natural brake power of the engine is sufficient to stop the vehicle, is shut off entirely.

Through this timed injection of the injection air 36 into the engine 1, the so-called cylinder filling of the combustion chambers 19 of the cylinders 20 can be considerably increased as a function of the volume of injection air 36 injected. In addition to the clock timing, which is predefined by the control of the control timing of the inlet valve 21, for example by means of a known camshaft (not shown) of the engine 1, the cross section of the injection line 7 and the pressure in the second storage device 14 predominantly affect the injected volume of injection air 36.

The pressure in the second storage device 14, or the pressure downstream of the pressure regulator 9, is a variable value for changing the quantity of injection air 36. The adjustment of this pressure is carried out by the control device 16, for example via predefinable adjustment values or via data stored in a table in a memory device within the control device 16. This table data corresponds to the current operating state of the engine 1 and/or the vehicle at the time. For each operating state, therefore, the corresponding quantity of additional injection air 36 can be determined and supplied to the cylinder 20.

The increased cylinder filling now advantageously enhances the compression work of the cylinder 20 and thus leads to a clearly advantageous increase in the brake power of the engine 1.

Through integration of the control valve 8 timed by the control device 16 and of the (also optional) pressure regulator 9 into a total engine control electronic system of the engine control computer, the quantity of injection air 36 and, for example, the attained/desired braking speed of the engine 1 can be advantageously coordinated with one another, for example with reference to the above-mentioned table values stored in the memory device 16.

It is thereby ensured that after only a few revolutions of the crankshaft of the engine 1 with the additional quantity of injection air 36, the brake power of the engine is strongly increased and the vehicle speed effectively reduced.

After a sufficiently reduced vehicle speed has been reached, the additional injection air 36 is immediately switched off by the control device 16 via the control valve 8 and the significantly less powerful engine brake usually installed, for example the exhaust butterfly valve 26, takes over the braking operation.

In the event that, firstly, the charge pressure should fall below a desired value also predefinable for the control device 16, for example in rapidly alternating acceleration and braking phases, or, secondly, the "natural" brake power of the engine 1 should be insufficient for short-term rapid and heavy braking processes, in these phases the control device 16 can activate the supply of additional injection air 36 alternately for both acceleration and braking in any desired manner.

Thus, if an engine input-output map is present, for example in table values of the memory device of the control device 16, the necessary quantity of additional injection air 36 for any operating state of the engine 1 and of the vehicle can advantageously be determined by the control device 16 and supplied to the engine 1, whereby an advantageous power increase of the engine 1 is made possible during both accelerating and braking.

The invention is not restricted to the above-described exemplary embodiment.

For example, it is possible for the feed valve 15 to be configured as an autonomous valve, as is often used for compressed air systems.

The actuator may also be coupled to an actuating device for camshaft control timing.

Furthermore, the invention is applicable to engines 1 with one or more cylinders 20 with one or more inlet and exhaust valves 21, 27, the configuration of the engine 1 not being restricted to a diesel engine.

It is also possible that the injection air 36 passes through a heat exchanger before being injected into the cylinders 20, so that its temperature can be optimally adapted to the operating state of the engine 1 at the time.

Moreover, a vehicle without a compressed air braking system may have only the second storage device 14 instead of two storage devices 10 and 14, in which case the feed valve 15 may be omitted.

The air compressor 11 may additionally be connected directly to the inlet of the control valve 8 via a connection, for example a controllable bypass valve, controllable by the control device 16.

An additional butterfly valve 35 which is controlled by the control device 16 may be arranged in the charge air supply line 34 in order to block the charge air supply line 34 in certain brake operating states.

TABLE OF REFERENCES NUMERALS

1 Engine
2 Exhaust gas line
3 Turbine
4 Compressor
5 Charge air cooler
6 Charge air line
7 Air injection conduit
8 Control valve
9 Pressure regulator
10 First storage device
11 Air compressor
12 Change-over valve
13 Drier device
14 Second storage device
15 Feed valve
16 Control device
17 First air inlet
18 Reciprocating piston
19 Combustion chamber
20 Cylinder
21 Inlet valve
22 Inlet duct
23 Inlet flow
24 Exhaust gas line upstream of turbine
25 Exhaust gas line downstream of turbine
26 Exhaust butterfly valve
27 Exhaust valve
28 Cylinder head
29 Brake valve
30 Compressor boost line
31 Second air inlet
32 Air line
33 Connecting line
34 Charge air supply line
35 Butterfly valve
36 Injection air The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for increasing the engine brake power of an internal combustion engine having at least one cylinder with at least one inlet valve and a brake valve in each case, comprising the acts of:

compressing air from at least one of an engine charge air line and a second air inlet by an air compressor;

storing of the air compressed by the air compressor in at least one storage device, and injecting during an engine braking process at least one of compressed air stored in the at least one storage device and compressed air delivered from the air compressor into the at least one cylinder in a timed manner to increase an amount of air filling the at least one cylinder during a cylinder intake event and thereby to increase a compression work in the at least one cylinder during the cylinder compression event, wherein the compressed air is first fed to a first storage device and stored therein, and the air stored in the first storage device is fed to a second storage device via a feed valve for storage in the second storage device when air at a predetermined pressure is present in the first storage device.

2. The method as claimed in claim 1, wherein the feed valve is controlled by a control device.

3. The method as claimed in claim 1, wherein the injecting step comprises:

determining by reference to data from at least one of an engine control computer and vehicle sensors a current operating state of at least one of the engine and of the vehicle;

determining a pressure in the at least one storage device and a charge pressure in the charge air line and transmitting the determined pressures to a control device;

controlling the injecting of compressed air into the at least one cylinder during a braking process by opening a compressed air control valve under the control of a control device such that the compressed air enters the cylinder when the cylinders inlet valve is opened; and ending the compressed injecting of air into the cylinder when the engine is in an operating state in which the engine is capable of generating a level of brake power corresponding to a driver's engine brake demand without compressed air injection.

4. The method as claimed in claim 3, wherein in a time segment for opening the control valve by the control device is determined by a predefined data value.

5. The method as claimed in claim 3, wherein the control device adjusts a quantity of compressed air being injected as a function of the operating state of at least one of the engine and the vehicle using a pressure regulator.

6. The method as claimed in claim 5, wherein the quantity of injection air and control timings of the inlet valve and of an engine brake valve are adjusted in a mutually coordinated manner by the control device as a function of the operating state of the engine with in accordance with predefined values.

7. The method as claimed in claim 6, wherein an inlet of the air compressor is connected via a change-over valve to a second air inlet or to a charge air line as a function of the pressure in the charge air line.

8. The method as claimed in claim 7, wherein during the timed injection of compressed air from the air compressor, a controllable butterfly valve in a charge air supply line to the charge air line is closed by the control device.

9. A device for increasing an engine brake power of an internal combustion engine, comprising:

at least one cylinder with at least one inlet valve and one exhaust valve;

a first storage device;

a compressed air control valve; and a control device arranged to control the compressed air control valve, wherein an outlet of the at least one storage device is connected via a control valve to at least one of an inlet duct and an intake tract of the engine, the control device is configured to open the compressed air control valve in a timed manner during an engine braking process in order to increase an amount of air filling the at least one cylinder during a cylinder intake event and thereby increase a compression work in the at least one cylinder during the cylinder compression event, and an inlet of a second storage device is connected via a feed valve to the first storage device.

10. The device as claimed in claim 9, wherein the control valve and an outlet of at least one of the storage devices are connected via a pressure regulator.

11. The device as claimed in claim 10, wherein the storage device outlet is further connected to the inlet duct via a heat exchanger.

12. The device as claimed in claim 11, wherein an air compressor is further connected to an inlet of the control valve via a controllable connection.

13. The device as claimed in claim 12, wherein a charge air supply line from a charge compressor to the charge air line has a controllable butterfly valve.

14. The device as claimed in claim 13, wherein the control valve and the butterfly valve are arranged in a common housing.

15. The device as claimed in claim 14, wherein an air injection line is connected to the inlet duct via at least one of an air injection conduit and an injection line for the compressed air, the at least one of the injection duct and the injection line being formed in a cylinder head of the engine or arranged in the inlet duct.

* * * * *